US010641531B2

(12) United States Patent
Klemen et al.

(10) Patent No.: US 10,641,531 B2
(45) Date of Patent: May 5, 2020

(54) SUPERCRITICAL TRANSIENT STORAGE OF REFRIGERANT

(71) Applicant: Rolls-Royce Corporation, Indianapolis, IN (US)

(72) Inventors: Donald Klemen, Carmel, IN (US); Eric E. Wilson, Mooresville, IN (US); Patrick C. Sweeney, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 15/465,652

(22) Filed: Mar. 22, 2017

(65) Prior Publication Data

US 2017/0314830 A1 Nov. 2, 2017

Related U.S. Application Data

(60) Provisional application No. 62/328,351, filed on Apr. 27, 2016.

(51) Int. Cl.
*F25B 45/00* (2006.01)
*F25B 43/00* (2006.01)
(Continued)

(52) U.S. Cl.
CPC ..... *F25B 45/00* (2013.01); *F25B 9/008* (2013.01); *F25B 43/006* (2013.01); *F25B 49/02* (2013.01);
(Continued)

(58) Field of Classification Search
CPC ..... F25B 9/008; F25B 2309/061; F25B 2400/0415; F25B 2400/16; F25B 2600/2523
See application file for complete search history.

(56) References Cited

U.S. PATENT DOCUMENTS 5,586,443 A * 12/1996 Lewis ..... F25B 1/00 62/115
5,655,378 A * 8/1997 Pettersen ..... F25B 1/00 62/174
(Continued)

FOREIGN PATENT DOCUMENTS

DE 102006001919 A1 7/2007
DE 102009041459 A1 3/2011
(Continued)

OTHER PUBLICATIONS

Communication pursuant to Rule 69 EPC and Rule 70a(1) EPC dated Nov. 6, 2017, from counterpart European Application No. 17163925.5, 2 pp.
(Continued)

*Primary Examiner* — Christopher R Zerphey
(74) *Attorney, Agent, or Firm* — Shumaker & Sieffert, P.A.

(57) ABSTRACT

A refrigeration system is described that includes a compression device configured to increase a pressure of a refrigerant. The refrigeration system further includes a first heat exchanger configured to reject heat from the refrigerant and reduce a temperature of the refrigerant. The refrigeration system further includes a storage device configured to store the refrigerant at a supercritical state. The refrigeration system further includes an expansion device configured to reduce the pressure of the refrigerant. The refrigeration system further includes a second heat exchanger configured to absorb heat into the refrigerant and increase the temperature of the refrigerant. The refrigeration system further includes a controller configured to release the refrigerant from the storage device to the expansion device to provide cooling capacity to the refrigeration system.

20 Claims, 11 Drawing Sheets

(51) Int. Cl.
*F25B 49/02* (2006.01)
*F25B 9/00* (2006.01)

(52) U.S. Cl.
CPC ..... *F25B 2309/061* (2013.01); *F25B 2400/16* (2013.01); *F25B 2400/23* (2013.01); *F25B 2500/26* (2013.01); *F25B 2600/0251* (2013.01); *F25B 2600/2523* (2013.01)

(56) References Cited

U.S. PATENT DOCUMENTS

| | | | | |
|---|---|---|---|---|
| 7,024,883 | B2 | 4/2006 | Sienel et al. | |
| 7,096,679 | B2 * | 8/2006 | Manole | F25B 1/10 62/115 |
| 7,891,201 | B1 | 2/2011 | Bush et al. | |
| 7,897,201 | B2 | 3/2011 | Yuasa et al. | |
| 8,109,105 | B2 * | 2/2012 | Unezaki | F25B 9/008 62/129 |
| 8,181,470 | B2 | 5/2012 | Narayanamurthy et al. | |
| 9,068,765 | B2 | 6/2015 | Huff | |
| 2005/0132729 | A1 | 6/2005 | Manole | |
| 2010/0115975 | A1 | 5/2010 | Mitra et al. | |
| 2010/0132399 | A1 | 6/2010 | Mitra et al. | |
| 2011/0041523 | A1 | 2/2011 | Taras et al. | |
| 2011/0138825 | A1 * | 6/2011 | Chen | F25B 49/02 62/115 |
| 2014/0260340 | A1 | 9/2014 | Vaisman et al. | |
| 2014/0366563 | A1 | 12/2014 | Vaisman et al. | |

FOREIGN PATENT DOCUMENTS

| | | | |
|---|---|---|---|
| DE | 102014102830 | A1 | 9/2015 |
| WO | 2010140056 | A1 | 12/2010 |
| WO | 2011091014 | A2 | 7/2011 |

OTHER PUBLICATIONS

Response to Communication pursuant to Rule 69 EPC and Rule 70a(1) EPC dated Nov. 6, 2017, and Extended European Search Report dated Jul. 6, 2017, from counterpart European Application No. 17163925.5, filed Apr. 11, 2018, 7 pp.
Extended Search Report from counterpart European Application No. 17163925.5, dated Jul. 6, 2017, 9 pp.
Kim et al., "Fundamental process and system design issues in CO2 vapor compression systems", Progress in Energy and Combustion Science 30 (2004) 119-174, Sep. 2004, 56 pgs.
Danfoss, "Application guide—Transcritical CO2 booster system: How to control the system", Retrieved from www.danfoss.com/co2, Oct. 2010, 6 pgs.
Trocolli, "What You Should Know About Flash Tanks", Shipco Pumps, Apr. 2004, 4 pgs.
Communication pursuant to Article 94(3) EPC, dated Jun. 20, 2018 from counterpart European Application No. 17163925.5 (4 pgs.).
Response to Examination Report dated Jun. 20, 2018, from counterpart European Application No. 17163925.5, filed Oct. 12, 2018, 87 pp.
Summons to attend oral proceedings pursuant to Rule 115(1) EPC from European Patent Application No. 17163925.5, dated Mar. 20, 2019, 7 pp.
Communication under Rule 71(3) EPC from European counterpart application No. 17163925.5, dated Oct. 31, 2019, 47 pgs.

* cited by examiner

SUPERCRITICAL TRANSIENT STORAGE OF REFRIGERANT

This application claims the benefit of U.S. Provisional Application No. 62/328,351 filed Apr. 27, 2016, which is incorporated herein by reference in its entirety.

TECHNICAL FIELD

This disclosure relates to refrigerant systems.

BACKGROUND

Refrigerant systems that provide cooling for various applications may cycle on and off to maintain the temperature of the system to be within a desired temperature band. When a refrigerant system reaches the desired low temperature, the refrigerant system may cycle off to prevent further cooling and/or to conserve power. When the system is stopped, the temperature of the system may naturally increase. Before the system temperature meets or exceeds the maximum temperature of the temperature band, the refrigerant system may restart. After the refrigerant system is restarted, there may be a brief time delay before the refrigerant system can attain cooling capacity to effectively cool the system. For example, when the refrigeration system is restarting, the masses in the refrigerant system may need time to stabilize, and the pressure in the system may need time to build before cooling can occur.

SUMMARY

In some examples, the disclosure describes a refrigeration system including a compression device configured to increase a pressure of a refrigerant. The refrigeration system further includes a first heat exchanger configured to reject heat from the refrigerant and reduce a temperature of the refrigerant. The refrigeration system further includes a storage device configured to store the refrigerant at a supercritical state. The refrigeration system further includes an expansion device configured to reduce the pressure of the refrigerant. The refrigeration system further includes a second heat exchanger configured to absorb heat into the refrigerant and increase the temperature of the expanded refrigerant. The refrigeration system further includes a controller configured to release the refrigerant from the storage device to the expansion device to provide cooling capacity to the refrigeration system.

In some examples, the disclosure describes a method including, after starting a compression device of a refrigeration system, storing, by a controller of the refrigeration system, at a storage device of the refrigeration system, refrigerant at a supercritical state. The method further includes, after stopping the compression device, determining, by the controller, that the refrigeration system needs cooling capacity. The method further includes, in response to determining that the refrigeration system needs cooling capacity while the compression device is stopped, releasing, by the controller, from the storage device, the refrigerant that is stored at the supercritical state.

In some examples, the disclosure describes a system that includes means for, after starting a compression device of a refrigeration system, storing refrigerant at a supercritical state. The system further includes means for, after stopping the compression device, determining that the refrigeration system needs cooling capacity. The system further includes means for, in response to determining that the refrigeration system needs cooling capacity while the compression device is stopped, releasing the refrigerant that is stored at the supercritical state.

The details of one or more examples are set forth in the accompanying drawings and the description below. Other features, objects, and advantages will be apparent from the description and drawings, and from the claims.

DETAILED DESCRIPTION

In general, this disclosure describes techniques for enabling a refrigeration system that uses a vapor compression cycle to provide immediate cooling, regardless as to whether a compression device of the refrigeration system is running or stopped. The refrigeration system includes a storage device configured to store high-pressure refrigerant at a supercritical state. Given the supercritical state, the refrigerant may not require any further compression before being applied to the refrigeration loop to provide immediate cooling capacity.

A refrigeration system may have a strict operating temperature band. Such a system may remain within the temperature band by running a compression device to provide a constant source of high-pressure, supercritical refrigerant. Running a compression device in this way may result in an unwanted increase in fuel and/or power consumption due to the constant power required by the compression device. However, if the compression device is stopped, the compression device may need several seconds or even minutes after being restarted to regain its cooling capacity. By utilizing a supercritical, pressurized refrigerant storage device, an example refrigeration system, as described herein, may consume less power and/or fuel to maintain a temperature range by stopping the compression device. The example refrigeration system may instead rely on the immediate cooling capacity of the supercritical, high-pressure storage device.

Figure 1:
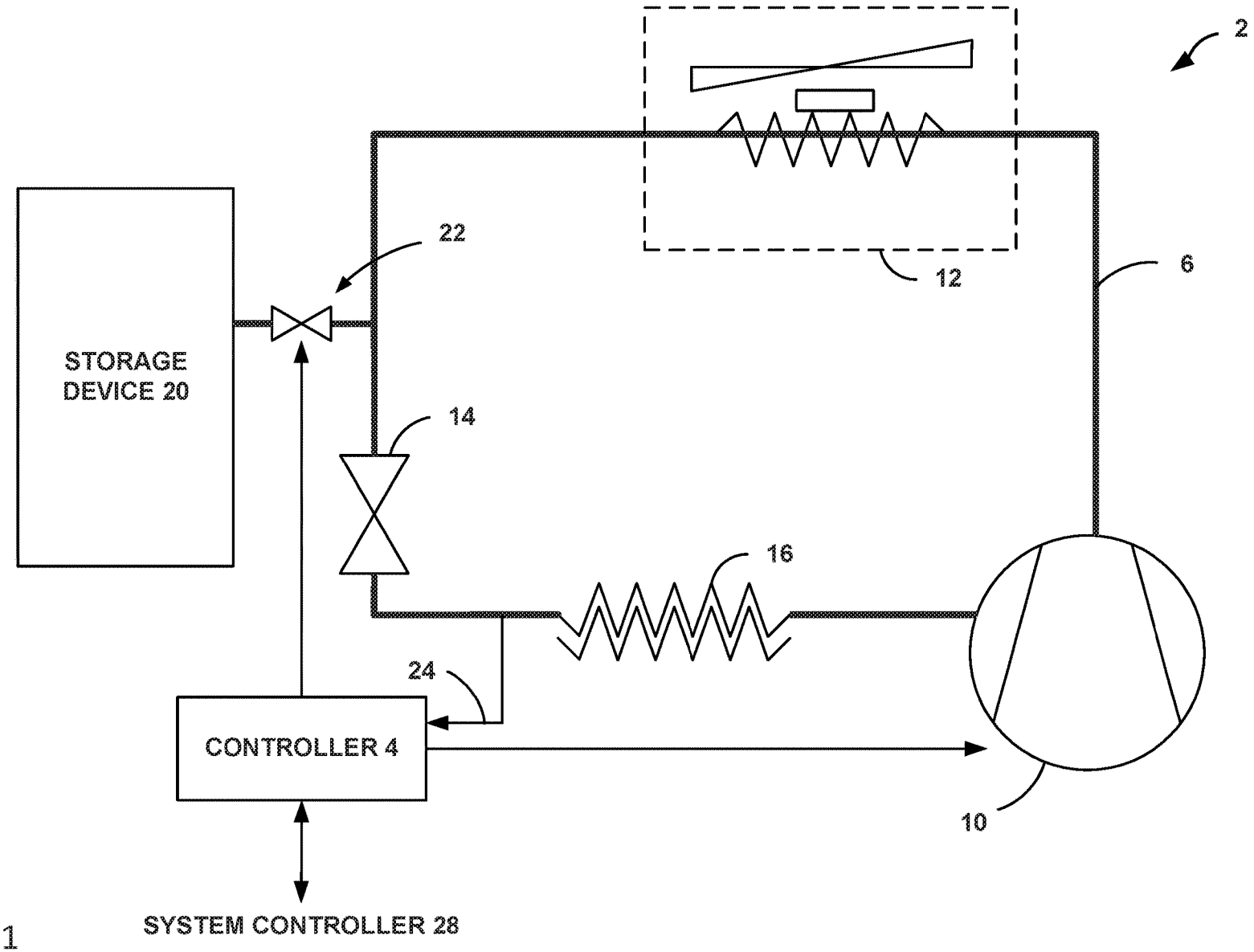
FIG. 1 is a conceptual diagram illustrating an example refrigeration system that includes a supercritical, transient storage device, in accordance with some examples of this disclosure.

FIG. 1 is a conceptual diagram illustrating refrigeration system 2 as an example refrigeration system that includes a supercritical, high-pressure transient storage device in accordance with some examples of this disclosure. Refrigeration system 2, which may also be known as a cooling system, may implement a vapor compression cycle to provide cooling capacity. The vapor compression cycle may include compression device 10, heat exchanger 12, expansion device 14, heat exchanger 16, and storage device 20, all connected by refrigeration loop 6. Heat exchanger 12 may be referred to as heat rejection heat exchanger 12, heat exchanger 16 may be referred to as heat absorption heat exchanger 16, and storage device 20 may be referred to as supercritical, high pressure transient storage device 20. Storage device 20 may be connected to refrigeration loop 6 via storage device valve 22. Refrigeration system 2 may be a refrigerator, supermarket cooling system, an air conditioning system, or another refrigeration application.

Refrigerant loop 6 may carry a refrigerant such as carbon dioxide or a chlorofluorocarbon. In some examples, refrigerant loop 6 is configured to implement a transcritical refrigeration cycle, and the refrigerant may transition from a gaseous state to a supercritical state as compression device 10 increases the pressure of the refrigerant. The refrigerant may remain in a supercritical state as the refrigerant passes through heat rejection heat exchanger 12. The refrigerant may then transition from a supercritical state to a liquid state as expansion device 14 reduces the pressure of the refrigerant. The refrigerant may transition from a liquid state to a gaseous state as heat absorption heat exchanger 16 increases the temperature of the refrigerant. A desirable refrigerant in a transcritical process may have a boiling point that is below the target temperature for the substance to be refrigerated, so that evaporation may occur in heat exchanger 16. A desirable refrigerant in a transcritical process may also have a high heat of vaporization to allow for maximum heat transfer in heat exchanger 16. A desirable refrigerant in a transcritical process may have a high density in gaseous form.

Compression device 10 is configured to increase a pressure of the refrigerant. Compression device 10 may increase the pressure of the refrigerant by reducing its volume. By increasing the pressure of the refrigerant, compression device 10 may also increase the temperature of the refrigerant. Compression device 10 may compress the refrigerant into a supercritical state. Compression device 10 may start and stop periodically in order to save energy, as compared to compression device 10 running continuously. Compression device 10 may have variable speed or displacement to allow variation in mass flow, which may control the cooling rate of refrigeration system 2. Compression device 10 may run on mechanical power or electrical power. In some examples, compression device 10 may be a gas compressor, such as a reciprocating compressor, a rotary screw compressor, a centrifugal compressor, or a scroll compressor.

Heat rejection heat exchanger 12 is configured to reduce a temperature of a refrigerant. In a transcritical refrigeration system, it may be desirable to avoid condensation in heat exchanger 12 so that the refrigerant remains in a supercritical state. In some examples, heat exchanger 12 may be a finned tube heat exchanger, a plate fin heat exchanger, or any other heat exchanger architecture cooled by an air flow induced by a fan, blower, or other source of positive air pressure.

Storage device 20 is configured to store the refrigerant at a pressurized state which may be supercritical. Storage device 20 may be a pressure vessel made of a single material or a composite of materials such as metals and/or polymers. Storage device 20 may have sufficient strength to withstand supercritical pressures of the refrigerant in use. For example, the critical point for carbon dioxide has a pressure of more than one thousand pounds per square inch. Therefore, storage device 20 may be configured to withstand pressures exceeding the maximum pressure that the refrigerant may achieve under supercritical pressure. In some examples, storage device 20 may store refrigerant at a pressure of two thousand pounds per square inch. Storage device 20 may not require moving parts to operate because the operational energy is stored in the supercritical refrigerant or compressed gas.

Expansion device 14 is configured to reduce the pressure of the refrigerant. Expansion device 14 may be an expansion valve that reduces the pressure of the refrigerant flowing into heat absorption exchanger 16. By reducing the pressure of refrigerant into heat exchanger 16, expansion device 14 produces a low temperature in heat exchanger 16. A low temperature in heat exchanger 16 may induce heat transfer between the refrigerant and the substance to be refrigerated. In some examples, expansion device 14 may be a simple orifice, and adjustable valve, or a work absorbing device such as an expansion turbine. In examples where expansion device 14 is an adjustable valve, the valve position may use feedback from the refrigerant pressure and temperature in heat exchanger 16 to control the expansion process.

Heat exchanger 16 is configured to increase a temperature of the refrigerant. Heat exchanger 16 may be an evaporator that converts liquid refrigerant into a gaseous state. As the refrigerant evaporates in heat exchanger 16, the substance to be refrigerated may transfer heat to the refrigerant. The pressure of the refrigerant in heat exchanger 16 may depend on the refrigerant properties desired and may be, in some examples, five hundred and sixty pounds per square inch. In some examples, heat exchanger 16 may be a natural/forced circulation evaporator, a falling film evaporator, a long tube vertical evaporator, or a climbing and falling-film plate evaporator.

Controller 4 is configured to control the components of refrigeration system 2 such that refrigeration system 2 implements a vapor compression cycle to provide cooling capacity. Controller 4 is configured to release the refrigerant from storage device 20 to provide cooling capacity to refrigeration system 2. Controller 4 may also be configured to open storage device valve 22 to store the refrigerant in storage device 20. Controller 4 may use a decision algorithm to determine when to open or close storage device valve 22. Controller 4 may store or release the refrigerant from storage device 20 by controlling storage device valve 22, which may be coupled to storage device 20 and refrigerant loop 6. In some examples, storage device valve 22 may be a ball valve, or a diaphragm valve. Storage device valve 22, for controlled operation, may be a solenoid operated valve.

Controller 4 may also be configured to control how and when refrigeration system 2 distributes, and refrains from distributing, the refrigerant in refrigerant loop 6. Controller 4 may circulate the refrigerant through refrigerant loop 6 while compression device 10 is running. While compression device 10 is running, controller 4 may circulate the refrigerant through heat exchangers 12 and 16 to provide cooling capacity to refrigeration system 2. While compression device 10 is running, controller 4 may open storage device valve 22 to store the refrigerant at storage device 20 at a supercritical state.

Controller 4 may stop compression device 10 to reduce fuel and/or power consumption if refrigeration system 2 no longer needs cooling capacity. Controller 4 may monitor the temperature of the substance to be refrigerated using a sensor or a thermostat, or, communication with another computer, such as a system controller, that is monitoring a remote temperature. Controller 4 may determine that refrigeration system 2 does not need cooling capacity based on a measurement of the temperature of the substance to be refrigerated. If controller 4 determines that refrigeration system 2 does not need cooling capacity, controller 4 may stop compression device 10 to reduce fuel and/or power consumption. Refrigeration system 2 may not need cooling capacity if the temperature of the substance to be refrigerated is near the low end of the allowable temperature band.

After stopping compression device 10, controller 4 may not circulate the refrigerant through compression device 10 and heat exchanger 12. While compression device 10 is stopped, controller 4 may determine that refrigeration system 2 needs cooling capacity. Controller 4 may determine that refrigeration system 2 needs cooling capacity based on a measurement of the temperature of the substance to be refrigerated. Controller 4 may determine that the refrigeration system 2 needs cooling capacity if the temperature of the substance to be refrigerated is above a threshold temperature. If controller 4 determines that refrigeration system 2 needs cooling capacity while compression device 10 is stopped, controller 4 may open storage device valve 22 to release compressed or supercritical refrigerant from storage device 20. Controller 4 may release the supercritical refrigerant from storage device 20 to provide immediate cooling capacity, even if compression device 10 has not been operational for a long period of time. By releasing supercritical refrigerant from storage device 20, the supercritical refrigerant will provide cooling capacity to refrigerant system 2 faster than if controller 4 merely started compression device 10 to compress the refrigerant already circulating through refrigeration loop 6.

In some examples, if controller 4 determines that refrigeration system 2 needs cooling capacity while compression device 10 is stopped, controller 4 may start compression device 10. Controller 4 may open storage device valve 22 to release the supercritical refrigerant from storage device 20 while simultaneously starting compression device 10. Controller 4 may open storage device valve 22 to release the supercritical refrigerant from storage device 20 after starting compression device 10. By opening storage device valve 22 simultaneously or after starting compression device 10, controller 4 may provide immediate cooling capacity to refrigeration system 2.

Controller 4 is shown as, generally, being operatively coupled to all of the components of refrigeration system 2, including compression device 10 and storage device valve 22. Although not specifically shown in FIG. 1, controller 4 may also be operatively coupled to each of the individual components of one or more of heat exchangers 12 and 16, expansion device 14, storage device 20, and refrigerant loop 6. In other words, controller 4 may provide and/or receive signals and information, to and/or from each of the different components 6, 10, 12, 14, 16, 20, and 22, and any other components required to cause refrigeration system 2 to distribute, and refrain from distributing, the refrigerant through refrigerant loop 6. For example, controller 4 may communicate with other control modules, such as a control module associated with expansion device 14 to regulate the flow of refrigerant into heat exchanger 16. Controller 4 may detect the temperature in refrigerant loop 4 via connection or sensor 24.

Controller 4 may comprise any suitable arrangement of hardware, software, firmware, or any combination thereof, to perform the techniques attributed to controller 4 herein. Examples of controller 4 include any one or more microprocessors, digital signal processors (DSPs), application specific integrated circuits (ASICs), field programmable gate arrays (FPGAs), or any other equivalent integrated or discrete logic circuitry, as well as any combinations of such components. When controller 4 includes software or firmware, controller 4 further includes any necessary hardware for storing and executing the software or firmware, such as one or more processors or processing units.

In general, a processing unit may include one or more microprocessors, DSPs, ASICs, FPGAs, or any other equivalent integrated or discrete logic circuitry, as well as any combinations of such components. Although not shown in FIG. 1, controller 4 may include a memory configured to store data. The memory may include any volatile or non-volatile media, such as a random access memory (RAM), read only memory (ROM), non-volatile RAM (NVRAM), electrically erasable programmable ROM (EEPROM), flash memory, and the like. In some examples, the memory may be external to controller 4 (e.g., may be external to a package in which controller 4 is housed).

Although controller 4 is generally described as being the primary unit for controlling each of the components of refrigeration system 2 for performing the techniques described herein, in some examples, the individual components of refrigeration system 2 may include additional functionality for performing some or all of the operations described below with respect to controller 4. For example, a combination of one or more of compression device 10, expansion device 14, and storage device 20 may include components for controlling the flow, storage, and release of refrigerant throughout refrigeration system 2.

In accordance with techniques of this disclosure, controller 4 may be configured to store, at storage device 20, the refrigerant at a supercritical state after starting compression device 10. For example, after controller 4 sends a control signal to compression device 10 to start compression device 10, compression device 10 may output compressed refrigerant to refrigeration loop 6 and heat exchanger 12. Upon exiting compression device 10, the compressed refrigerant is pressurized to a supercritical state. The refrigerant may remain in a supercritical state as the refrigerant enters and exits heat exchanger 12. The refrigerant may remain in a supercritical state until the refrigerant enters expansion device 14. After the supercritical refrigerant exits heat exchanger 12, controller 4 may direct the supercritical refrigerant into storage device 20. For example, controller 4 may control valve 22 to divert the supercritical refrigerant leaving heat exchanger 12 out of refrigerant loop 6 and into storage device 20.

Controller 4 may stop compression device 10 to reduce fuel and/or power consumption in refrigeration system 2. If the temperature of the substance to be refrigerated decreases such that refrigeration system 2 does not need cooling capacity, controller 4 may stop compression device 10.

Controller 4 may stop compression device 10 to reduce fuel and/or power consumption when controller 4 determines that refrigeration system 2 does not need cooling capacity.

Controller 4 may be configured to determine that refrigeration system 2 needs cooling capacity after stopping compression device 10. For example, controller 4 may detect the temperature of the substance to be refrigerated using a sensor or thermostat. The substance to be refrigerated may have a maximum temperature at the high end of the allowable temperature band. Controller 4 may determine that refrigeration system 2 needs cooling capacity when the temperature of the substance to be refrigerated approaches the maximum temperature. In order to remain at or below the maximum temperature, controller 4 may establish a threshold temperature below the maximum temperature at which controller 4 may determine that refrigeration system 2 needs cooling capacity. Controller 4 may determine that refrigeration system 2 needs cooling capacity by communicating with system controller 28. System controller 28 may communicate to controller 4 the temperature of an outside system that may include the substance to be refrigerated. System controller 28 may communicate with controller 4 in FIGS. 2-6, even though system controller 28 is not depicted in FIGS. 2-6.

Controller 4 may be configured to release the refrigerant that is stored at a supercritical state. Controller 4 may release the pre-compressed, supercritical refrigerant in response to determining that refrigeration system 2 needs cooling capacity while compression device 10 is stopped. Controller 4 may determine that refrigeration system 2 needs cooling capacity by measuring the temperature using a sensor or a thermostat. Controller 4 may compare the temperature measurement to a maximum temperature for the substance to be refrigerated. While compression device 10 is stopped, compression device 10 may need seconds or minutes to restart and regain cooling capacity. Controller 4 may need less time to release the supercritical refrigerant from storage device 20 than to restart compression device 10. During the restart time period for compression device 10 and refrigeration system 2, controller 4 may provide cooling capacity by releasing supercritical refrigerant from storage device 20.

Controller 4 may direct storage device 20 and storage device valve 22 to store and release supercritical refrigerant, thereby providing immediate cooling capacity to refrigeration system 2, and as such, provide cooling capacity much faster than other refrigeration systems that do not store supercritical refrigerant. The supercritical refrigerant in storage device 20 may be pre-compressed in a state necessary to provide cooling capacity. As a result, refrigeration system 2 may reduce fuel and/or power consumption by running compression device 10 less often.

Figure 2:
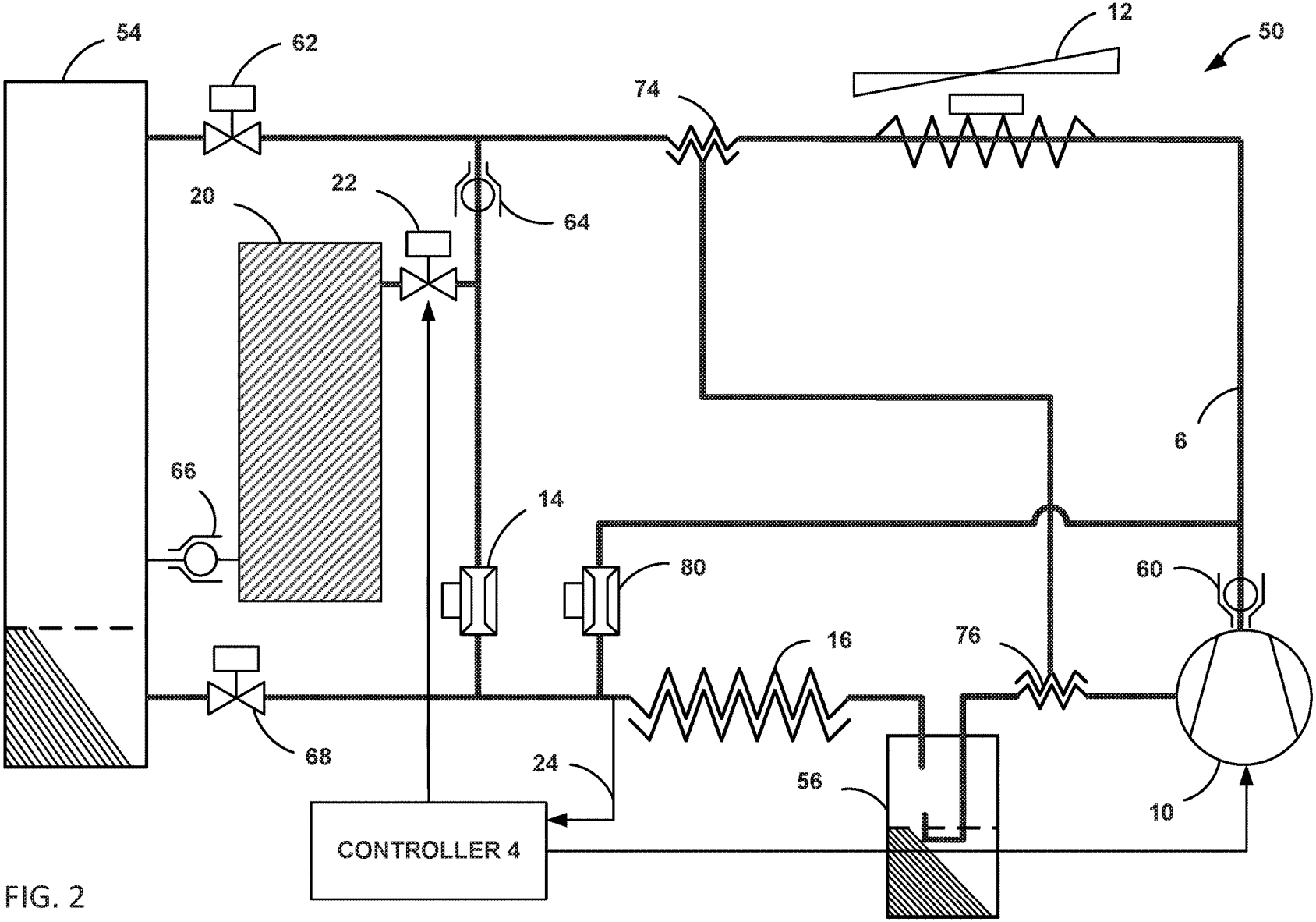
FIG. 2 is a conceptual diagram illustrating an example refrigeration system that includes a plurality of valves and a storage device, in accordance with some examples of this disclosure.

FIG. 2 is a conceptual diagram illustrating an example refrigeration system 50 that includes a plurality of valves 60, 62, 64, 66, 68, and 80 and a storage device 20, in accordance with some examples of this disclosure. Refrigeration system 50 contains controller 4, refrigerant 6, compression device 10, heat exchangers 12 and 16, expansion device 14, storage device 20, and storage device valve 22 in a similar configuration as refrigeration system 2 in FIG. 1. In addition, FIG. 2 depicts receiver 54, suction accumulator 56, valves 60, 62, 64, 66, 68, and 80, and recuperators 74 and 76. For ease of description, FIG. 2 is described in the context of refrigerant system 2 of FIG. 1.

Receiver 54 may be coupled to refrigerant loop 6 via mass removal valve 62 and mass addition valve 68. Receiver 54 may store refrigerant in a subcritical state, such as a gaseous state or a liquid state. Receiver 54 may store and release the subcritical refrigerant in order to increase or decrease the amount of refrigerant in refrigerant loop 6. As a result, by storing and releasing refrigerant in receiver 54, controller 4 may control the pressure in refrigerant loop 6. In some examples, receiver 54 may store refrigerant at a pressure between seven hundred and fifty pounds per square inch and one thousand pounds per square inch. Receiver 54 may operate at a pressure between a high pressure controlled by mass removal valve 62 and a low pressure controlled by mass addition valve 68. The pressure in receiver 54 may relate to the state of the refrigerant.

Controller 4 may measure the pressure and the amount of refrigerant in refrigerant loop 6 using sensors, strain gauges, or other suitable pressure measuring techniques. Controller 4 may control the amount of refrigerant in receiver 54 by opening and closing mass removal valve 62 and mass addition valve 68. If controller 4 determines that refrigerant loop 6 contains too much refrigerant and the pressure is too high, controller 4 may open mass removal valve 62 to allow the refrigerant to enter receiver 54. If controller 4 determines that refrigerant loop 6 contains too little refrigerant, controller 4 may open mass addition valve 68 to allow the refrigerant to exit receiver 54 into refrigerant loop 6.

Receiver 54 may be a passive device, meaning that receiver 54 may not change the temperature or pressure of the refrigerant stored in receiver 54. Controller 4 may release the subcritical refrigerant from receiver 54 after controller 4 starts compression device 10. For example, with compression device 10 running, controller may release the subcritical refrigerant from receiver 54 in response to determining refrigerant loop 6 needs more mass to maintain supercritical pressure on the high-pressure side of refrigeration system 50.

Suction accumulator 56 may be coupled to refrigerant loop 6 and may receive refrigerant from heat exchanger 16. Most or all of the refrigerant exiting heat exchanger 16 may be in a gaseous state; however some of the refrigerant exiting heat exchanger 16 may be in a liquid state. Refrigerant in a liquid state may damage compression device 10 or reduce the effectiveness of compression device 10. Therefore, suction accumulator 56 may separate refrigerant that is in a liquid state from the refrigerant that is in a gaseous state before the refrigerant enters compression device 10.

Valves 60, 64, and 66 may allow or impede the reverse flow of refrigerant through refrigerant system 50. Controller 4 may open or close valve 60, which may be a check valve, to control the flow of refrigerant out of compression device 10. Controller 4 may close valve 64 during transient operation to direct the flow of supercritical refrigerant through expansion device 14 and to direct the flow of subcritical refrigerant to receiver 54. Controller 4 or a higher receiver pressure, may cause valve 66 to open and increase the pressure in storage device 20 by allowing refrigerant to flow from receiver 54.

Recuperators 74 and 76 may transfer heat between two or more points along refrigerant loop 6. In some examples, recuperator 74 may remove heat from the supercritical refrigerant that has exited heat exchanger 12. Recuperator 76 may transfer the heat from recuperator 74 to the refrigerant that has exited heat exchanger 16.

Expansion device 80 may decrease the pressure of some of the refrigerant exiting compression device 10. Expansion device 80 may provide the expanded refrigerant to heat exchanger 16. Controller 4 may regulate the flow of refrigerant through expansion device 80 to control the rate of flow of the refrigerant through heat exchanger 16 to add heat to the refrigerant if necessary.

FIGS. 3A-6 illustrate refrigeration system 50 in various stages of charging and operation. FIGS. 3A-6 illustrate how storage device 20 may operate as a thermal capacitor by storing supercritical refrigerant as potential energy that can provide immediate cooling capacity. For ease of description, FIGS. 3A-6 are described in the context of refrigeration systems 2 and 50 of FIGS. 1 and 2.

Figure 3A:
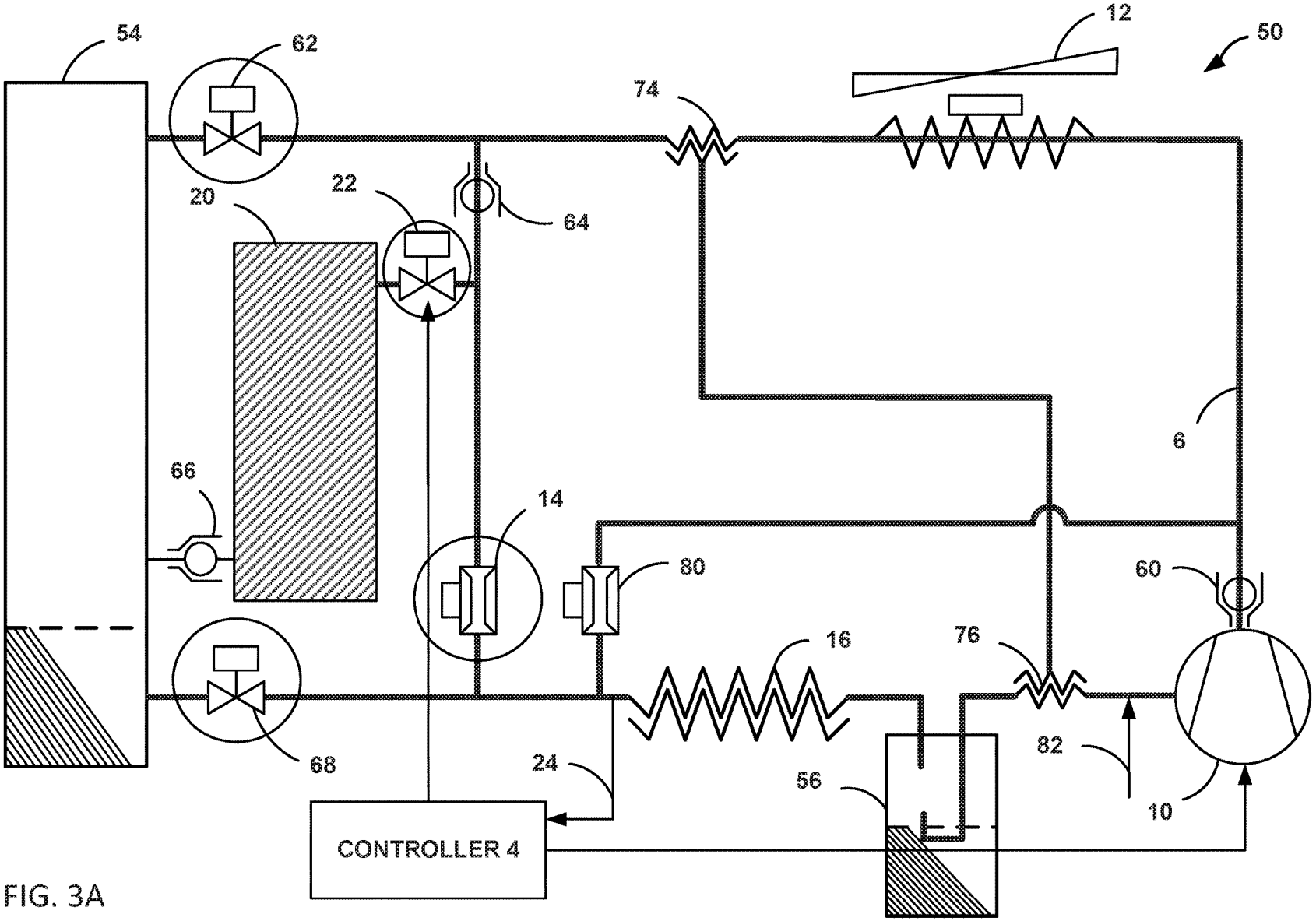
FIG. 3A is a conceptual diagram illustrating an example refrigeration system in an initial phase of an initial charging mode, in accordance with some examples of this disclosure.

FIG. 3A is a conceptual diagram illustrating an example refrigeration system 50 in an initial phase of an initial charging mode, in accordance with some examples of this disclosure. The pressure in refrigeration system 50 may increase due to an external fill system that supplies refrigerant via supply line 82. Controller 4 may open expansion device 14, storage device valve 22, mass removal valve 62, and mass addition valve 68 in the initial phase of the initial charging mode, as indicated by the solid-line circles surrounding around of these components. By opening expansion device 14, storage device valve 22, mass removal valve 62, and mass addition valve 68, controller 4 may cause refrigeration system 50 to have uniform pressure throughout the system. In the initial phase, controller 4 may direct compression device 10 or an external fill system (not shown in FIG. 3A) to increase the pressure in refrigeration system 50. The desired pressure of refrigeration system 50 in the initial phase may be the desired pressure of receiver 54, which may be, in some examples, between seven hundred and fifty pounds per square inch and one thousand pounds per square inch. FIG. 3A may represent the initial phase of an initial charging mode of a new refrigeration system or a refrigeration system that is recharging after depressurization for maintenance or repair.

Figure 3B:
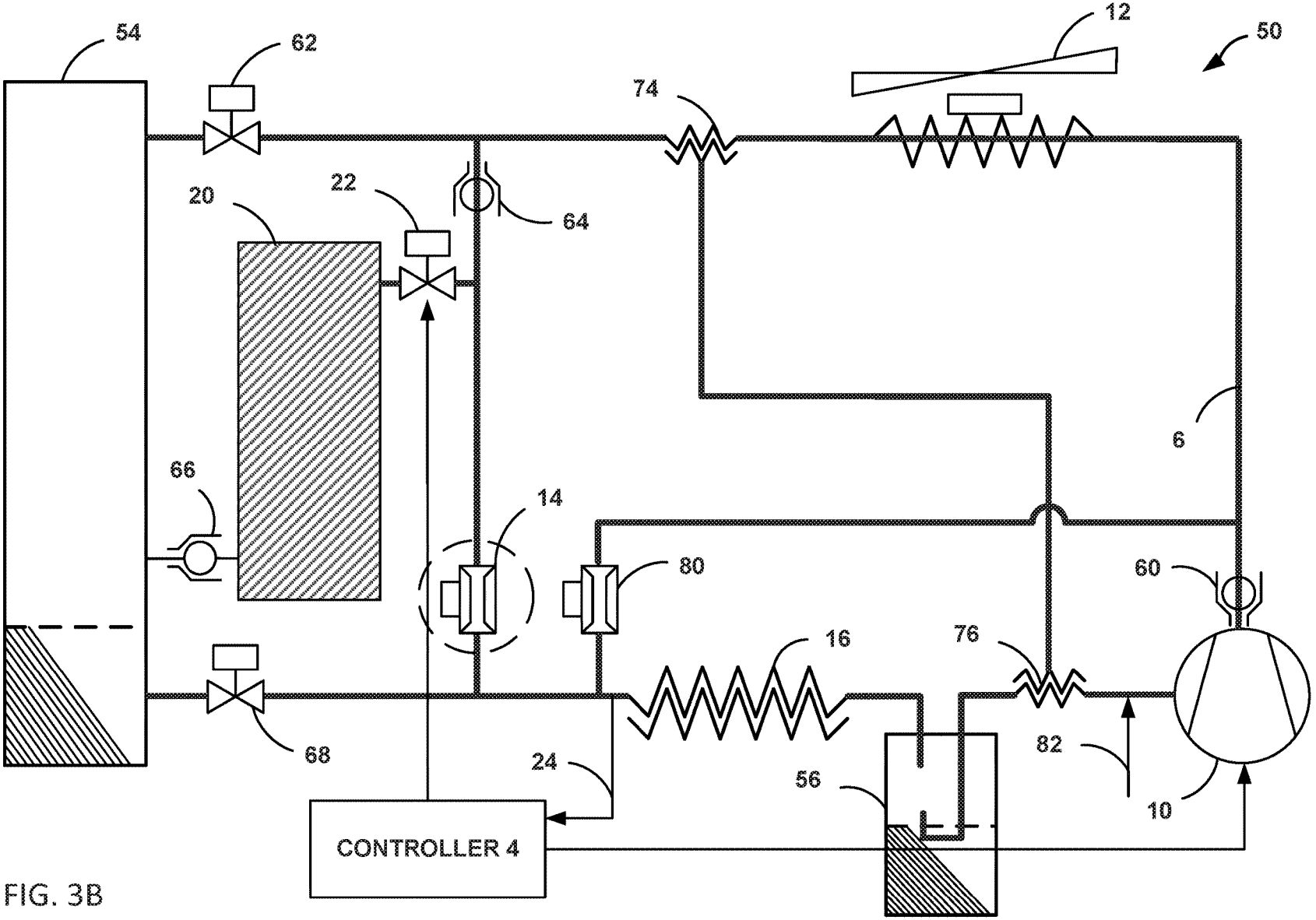
FIG. 3B is a conceptual diagram illustrating an example refrigeration system in an intermediate phase of an initial charging mode, in accordance with some examples of this disclosure.

FIG. 3B is a conceptual diagram illustrating an example refrigeration system 50 in an intermediate phase of the initial charging mode of FIG. 3B which occurs after the initial phase of the initial charging mode of FIG. 3B, in accordance with some examples of this disclosure. Controller 4 may close storage device valve 22, mass removal valve 62, and mass addition valve 68 in the intermediate phase to allow compression device 10 to charge refrigerant loop 6 to operating conditions. In the intermediate phase, controller 4 may start compression device 10 so that refrigeration system 50 may reach operational pressure conditions. Compression device 10 may charge the high pressure side of refrigerant loop 6 to a supercritical pressure, such as two thousand pounds per square inch. Expansion device 14 may be operational in the intermediate phase, as indicated by a dashed circle surrounding expansion device 14, and controller 4 may control the flow of refrigerant through expansion device 14 to achieve a desirable pressure along refrigerant loop 6. The external fill system may continue to provide refrigerant to refrigeration system 50 via supply line 82.

Figure 3C:
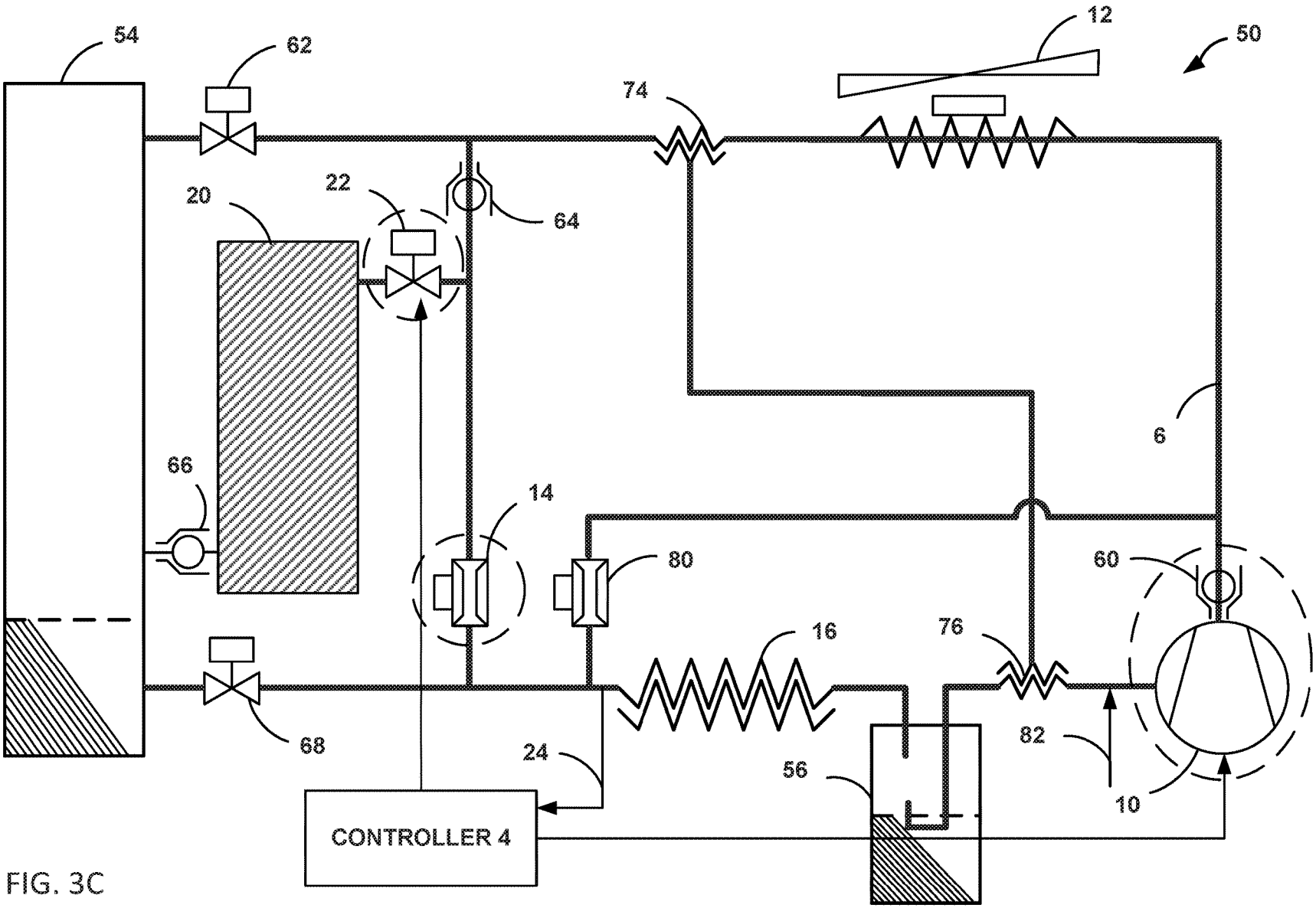
FIG. 3C is a conceptual diagram illustrating an example refrigeration system in a final phase of an initial charging mode, in accordance with some examples of this disclosure.

FIG. 3C is a conceptual diagram illustrating an example refrigeration system 50 in a final phase of the initial charging mode of FIG. 3A which occurs after the intermediate phase of the initial charging mode of FIG. 3B, in accordance with some examples of this disclosure. In the final phase, the pressure at storage device valve 22 may be at or above supercritical pressure. Compression device 10 and storage device valve 22 may be operational, as indicated by the dashed circles surrounding these components. Controller 4 may open storage device valve 22 to allow supercritical refrigerant to enter storage device 20. Compression device 10 may operate in a controlled manner until storage device 20 achieves a supercritical pressure. Controller 4 may need to maintain precise control over expansion device 14 and storage device valve 22 to maintain supercritical pressure on the high pressure side of refrigerant loop 6. At the end of the final phase of the initial charging mode, the external fill system may cease to provide refrigerant to refrigeration system 50 via supply line 82.

Figure 4:
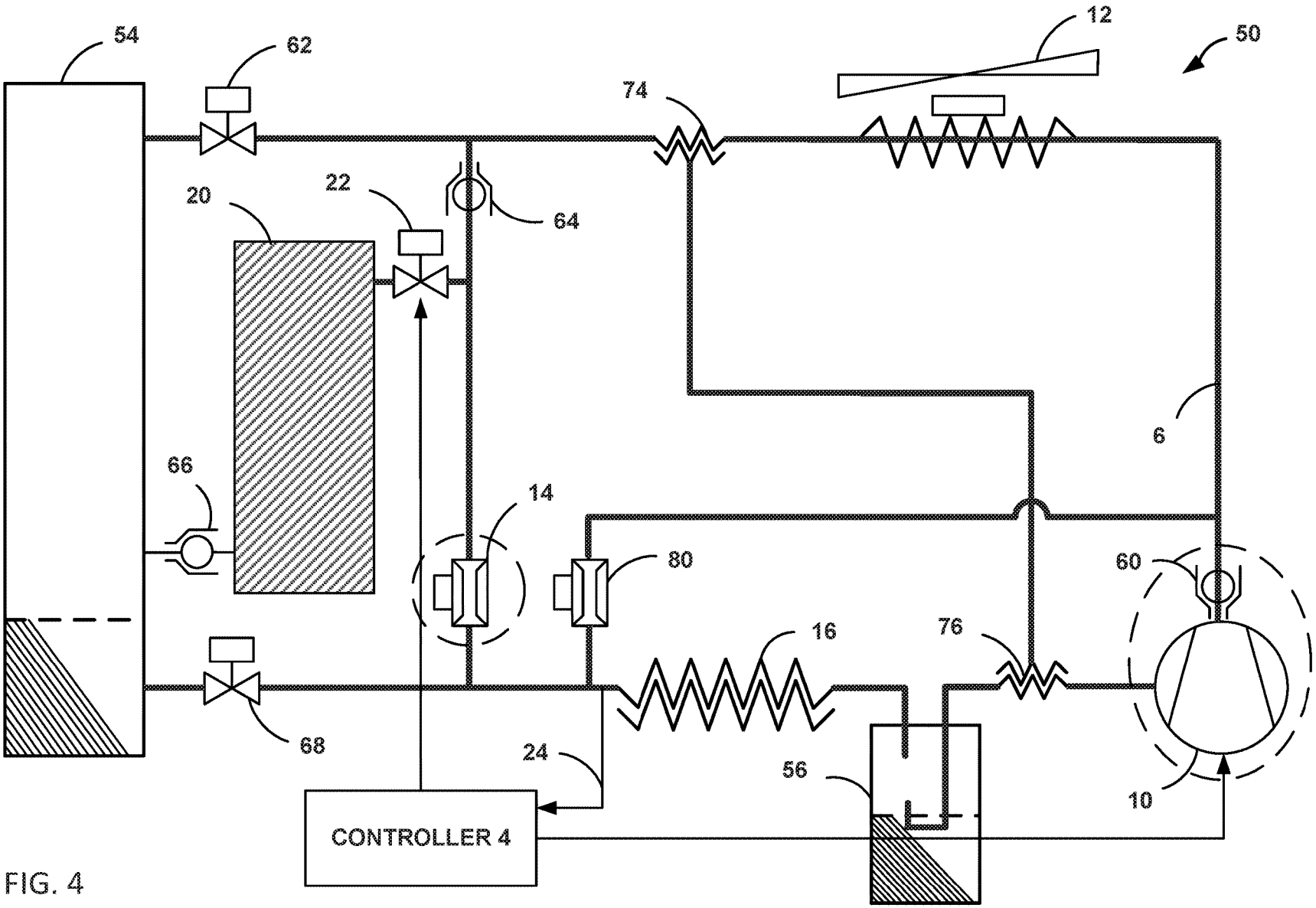
FIG. 4 is a conceptual diagram illustrating an example refrigeration system in normal operation, in accordance with some examples of this disclosure.

FIG. 4 is a conceptual diagram illustrating an example refrigeration system 50 in normal operation, in accordance with some examples of this disclosure. In normal operation, refrigeration system 50 is disconnected from an external fill system (not shown in FIG. 4) that may have connected to refrigeration system 50 in the initial charging mode. Compression device 10 and expansion device 14 may be operational such that refrigeration system 50 may provide cooling capacity via heat exchanger 16. Compression device 10 may operate on electrical or mechanical power in normal operation. Storage device valve 22 may close if the amount of supercritical refrigerant in storage device 20 is sufficient. Thus, in normal operation, compression device 10, instead of storage device 20, may provide cooling capacity to refrigeration system 50.

Figure 5:
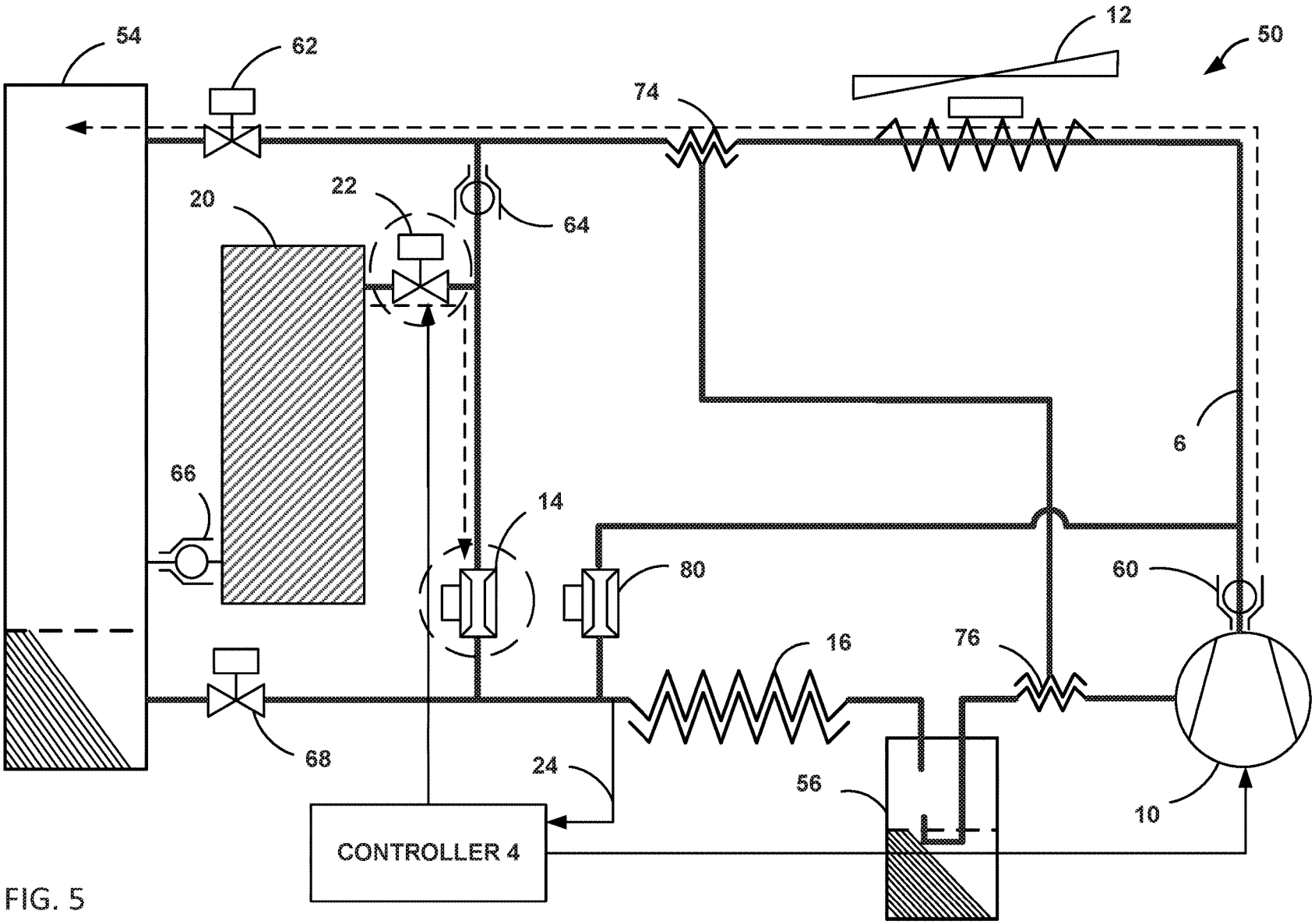
FIG. 5 is a conceptual diagram illustrating an example refrigeration system in transient operation, in accordance with some examples of this disclosure.

FIG. 5 is a conceptual diagram illustrating an example refrigeration system 50 in transient operation, in accordance with some examples of this disclosure. In transient operation, compression device 10 may stop and no longer operate on mechanical power. Controller 4 may decide to stop compression device 10 when the temperature of the substance to be refrigerated is below a threshold temperature. After stopping compression device 10, controller 4 may determine that refrigeration system 50 needs cooling capacity, based on a measurement of the temperature of the substance to be refrigerated. Controller 4 may open storage device valve 22 to release supercritical refrigerant from storage device 20 to expansion device 14, as indicated by the dashed line from storage device 20 to expansion device 14. Controller 4 may determine the rate at which to release supercritical refrigerant from storage device 20 based on the heat load requirements of refrigeration system 50. The supercritical refrigerant from storage device 20 may pass through expansion device 14 and heat exchanger 16, providing cooling capacity, and may enter compression device 10.

In transient operation, compression device 10 may compress the refrigerant to a subcritical pressure, despite compression device 10 not being fully operational. Compression device 10 may be a hybrid compressor that can run on electrical or mechanical power. In transient operation, compression device 10 may run on electricity to compress the expanded refrigerant to a subcritical pressure. Controller 4 may direct compression device 10 to run on electricity based on the release rate of refrigerant from storage device 20.

In transient operation, refrigerant loop 6 may move compressed subcritical refrigerant to receiver 54 to maintain desirable pressures throughout refrigeration system 50, as indicated by the dashed line from compression device 10 to receiver 54. In transient operation, the refrigerant may start as supercritical refrigerant in storage device 20 and end as subcritical refrigerant in receiver 54. Refrigeration system 50 and controller 4 may use receiver 54 as a temporary storage system in transient operation.

Controller 4 may restart compression device 10 before storage device 20 runs out of supercritical refrigerant or the amount of supercritical refrigerant otherwise drops below an acceptable level. Controller 4 may restart compression device 10 before the pressure inside storage device 20 declines below a supercritical level. For example, controller 4 may monitor the level of refrigerant and/or the pressure inside storage device 20 using a sensor, a strain gauge, or other measurement and monitoring technique to obtain information about the amount or pressure of refrigerant inside storage device 20. Controller 4 may start compression device 10 in response to determining the information indicates the refrigerant stored at storage device 20 needs replenishing.

Figure 6:
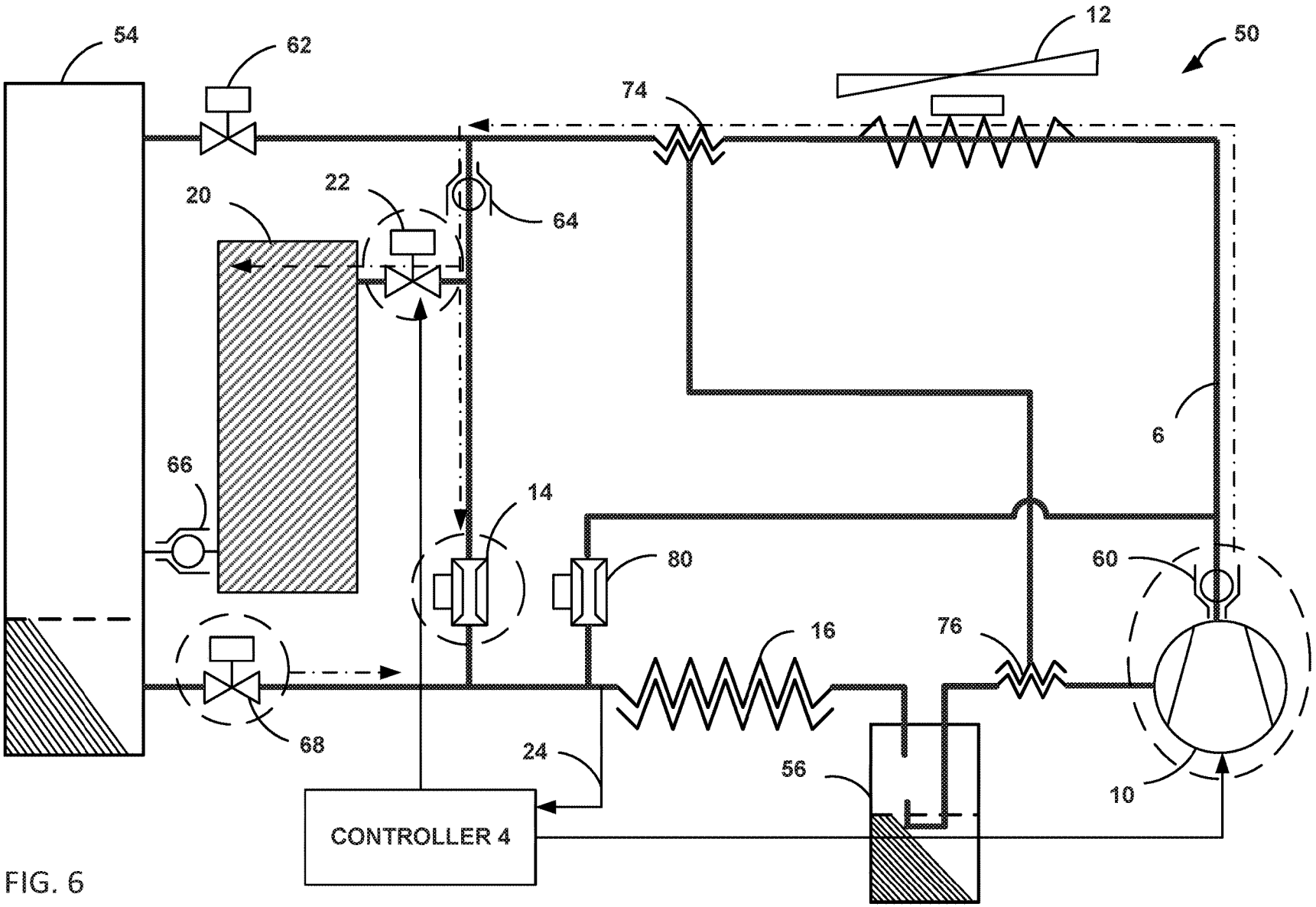
FIG. 6 is a conceptual diagram illustrating an example refrigeration system in recharge mode, in accordance with some examples of this disclosure.

FIG. 6 is a conceptual diagram illustrating an example refrigeration system 50 in recharge mode, in accordance with some examples of this disclosure. Recharge mode may occur after transient operation, when controller 4 restarts compression device 10. Controller 4 may operate mass addition valve 68 to release subcritical refrigerant from receiver 54 through heat exchanger 16 to compression device 10. Controller 4 may operate compression device 10 to compress the refrigerant to a supercritical state. Controller 4 may direct some of the supercritical refrigerant through refrigerant loop 6 to storage device 20 for storage. Thus, controller 4 may refill storage device 20 with refrigerant that was released from receiver 54 during transient operation.

FIG. 6 illustrates the balance between storage device 20 and receiver 54 within refrigeration system 50. As controller 4 directs storage device 20 to store supercritical refrigerant, the pressure decreases elsewhere in refrigeration loop 6. Receiver 54 acts as a reservoir to provide additional refrigerant into refrigerant loop 6 to maintain a desirable pressure. Similarly, as controller 4 directs storage device valve 22 to release supercritical refrigerant, the pressure increases in refrigeration loop 6. Receiver 54 acts as a sink to store refrigerant and maintain a desirable pressure in refrigerant loop 6.

Figure 7:
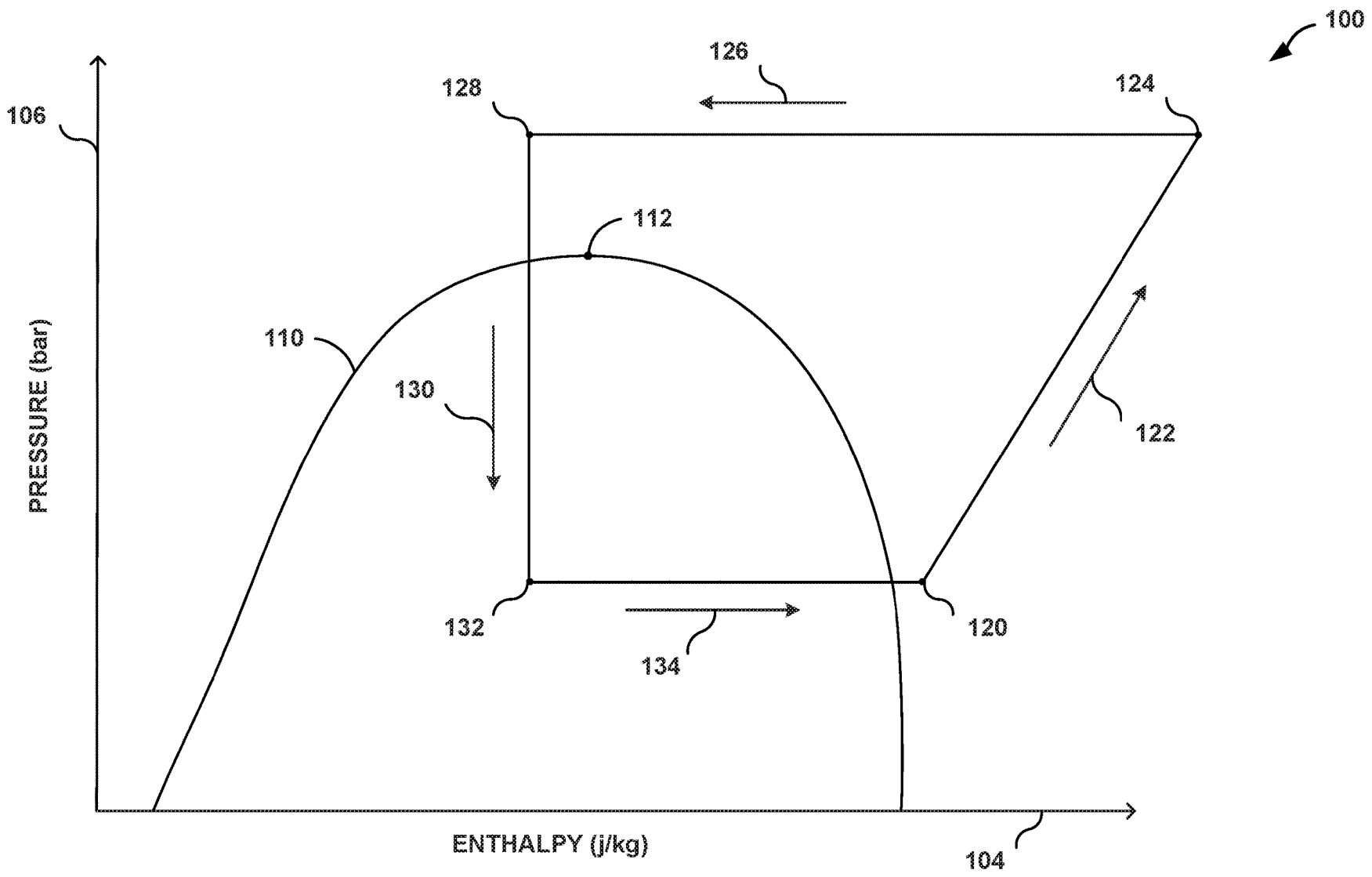
FIG. 7 is a graph of pressure and enthalpy for a refrigerant in a transcritical process, in accordance with some examples of this disclosure.

FIG. 7 is a graph 100 of pressure and enthalpy for refrigerant in a transcritical process, in accordance with some examples of this disclosure. Horizontal axis 104 of graph 100 may represent the enthalpy of the refrigerant. Enthalpy is a measure of the energy in the refrigerant. Enthalpy is related to temperature, but the relationship may be nonlinear. Vertical axis 106 of graph 100 may represent the pressure of the refrigerant. Curve 100 may represent a boundary for different phases of the refrigerant, based on enthalpy and pressure. Critical point 112 may represent an enthalpy and pressure at which the refrigerant transitions to a supercritical state. At temperatures and pressures above critical point 112, the refrigerant may exist in a supercritical state.

As the refrigerant enters compression device 10, point 120 may indicate the enthalpy and pressure of the refrigerant. The refrigerant at point 120 may exist in a gaseous state, as indicated by the position of point 120 to the right of curve 112. As compression device 10 increases the pressure of the refrigerant, arrow 122 may indicate the increase in the enthalpy and pressure of the refrigerant. As the refrigerant exits compression device 10, point 124 may indicate the enthalpy and pressure of the refrigerant. The refrigerant at point 124 may exist in a supercritical state, as indicated by the position of point 124 above and to the right of critical point 112.

As the refrigerant enters heat exchanger 12, point 124 may indicate the enthalpy and pressure of the refrigerant. As heat exchanger 12 reduces the temperature of the refrigerant, arrow 126 may indicate the decrease in the enthalpy of the refrigerant. As the refrigerant exits heat exchanger 12, point 128 may indicate the enthalpy and pressure of the refrigerant. The refrigerant at point 128 may exist in a supercritical state, as indicated by the position of point 128 above critical point 112. The refrigerant at point 128 may exist in a supercritical state if the temperature at point 128 is higher than the temperature at critical point 112, even if the enthalpy at point 128 is lower than the enthalpy at critical point 112. Controller 4 may open storage device valve 22 to store supercritical refrigerant in storage device 20.

As the supercritical refrigerant enters expansion device 14, point 128 may indicate the enthalpy and pressure of the refrigerant. As expansion device 14 reduces the pressure of the refrigerant, arrow 130 may indicate the decrease in the pressure of the refrigerant. As the refrigerant exits expansion device 14, point 132 may indicate the enthalpy and pressure of the refrigerant. The refrigerant at point 132 may exist in a liquid state, as indicated by the position of point 132 below curve 110. In addition, expansion of stored energy in an expanding turbine or compression device will also recover compressed stored energy and aid in fast starting of compression device 10.

As the refrigerant enters heat exchanger 16, point 132 may indicate the enthalpy and pressure of the refrigerant. As heat exchanger 16 increases the temperature of the refrigerant, arrow 134 may indicate the increase in the enthalpy of the refrigerant. As the refrigerant exits heat exchanger 16, point 120 may indicate the enthalpy and pressure of the refrigerant. If some of the refrigerant passing through heat exchanger 16 remains in a liquid state, point 120 may exist on or inside of curve 112. If the refrigerant remains in a state after exiting heat exchanger 16, suction accumulator 56 may remove the liquid refrigerant from refrigerant loop 6 before it enters compression device 10. A recuperative transfer via expansion device 80, as shown in FIG. 6, also aids in ensuring that full evaporation has occurred as the refrigerant enters compression device 10.

Figure 8:
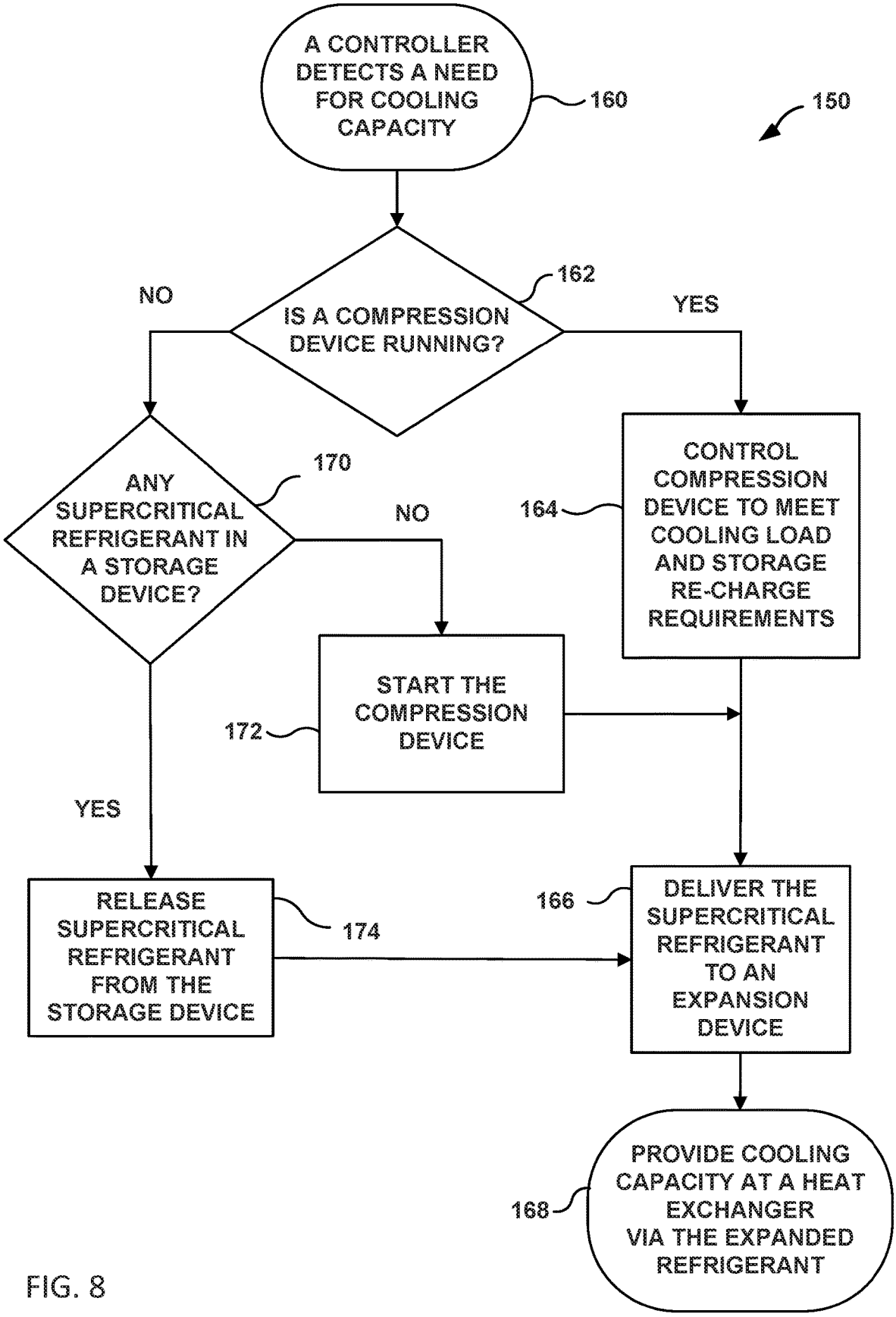
FIG. 8 is a flowchart illustrating the operation of an example refrigeration system that includes a supercritical, high pressure transient storage device, in accordance with some examples of this disclosure.

FIG. 8 is a flowchart illustrating the operation of an example refrigeration system 2 that includes a supercritical, high pressure transient storage device 20, in accordance with some examples of this disclosure. Process 150 is described in the context of refrigeration system 2 of FIG. 1, although other types of systems may perform similar techniques.

In operation, controller 4 may detect a need for cooling capacity in refrigeration system 2 (160). For example, controller 4 may use a sensor or thermostat to measure the temperature of the substance to be refrigerated. If the substance has a temperature near the maximum allowable temperature, controller 4 may determine that a need for cooling capacity exists in refrigeration system 2.

Responsive to determining a need for cooling capacity, controller 4 may determine whether compression device 10 is running (162). Controller 4 may have stopped compression device 10 to reduce fuel and/or power consumption in refrigeration system 2. Compression device 10 may be completely stopped, running on electric power at a low speed, or running on mechanical power at a full speed.

If controller 4 determines that compression device 10 is running, controller 4 may cause compression device 10 to provide more cooling capacity to refrigeration system 2 (164). For example, compression device 10 may be running at less than full speed. When controller 4 determines a need for cooling capacity, controller 4 may increase the power supplied to compression device 10 to increase the speed of compression device 10.

After causing compression device 10 to provide more cooling capacity, controller 4, via refrigerant loop 6, may deliver supercritical refrigerant to expansion device 14 (166). For example, controller 4 may increase the flow of supercritical refrigerant through expansion device 14 by opening or widening expansion device 14. Controller 4 may control expansion device 14 to meet the cooling load of refrigeration system 2 and to recharge storage device 20.

Lastly, after delivering supercritical refrigerant to expansion device 14, controller, via refrigerant loop 6, may provide cooling capacity at heat exchanger 16 via expanded refrigerant, which may have a lower temperature than the substance to be refrigerated (168). For example, controller 4 may control the flow into and through heat exchanger 16 by opening or closing expansion device 14. As expanded refrigerant flows through heat exchanger 16, the substance to be refrigerated transfers heat to the expanded refrigerant.

If controller 4 determines that compression device 10 is not running, controller 4 may determine whether storage device 20 contains any supercritical refrigerant (170). For example, controller 4 may use a sensor to determine how much, if any, supercritical refrigerant is in storage device 20.

If controller 4 determines that storage device 20 does not contain any supercritical refrigerant, controller 4 may start compression device 10 (172). For example, controller 4 may activate a mechanical power source to begin driving compression device 10 to provide supercritical refrigerant to refrigerant loop 6.

Controller 4, via refrigerant loop 6, may then deliver supercritical refrigerant to expansion device 14 (166) and provide cooling capacity at heat exchanger 16 via expanded refrigerant (168). For example, the supercritical refrigerant from compression device 10 may flow through heat exchanger 12, expansion device 14, and heat exchanger 16. The refrigerant may absorb heat from the substance to be refrigerated as the refrigerant flows through heat exchanger 16.

If controller 4 determines that storage device 20 contains supercritical refrigerant, controller 4 may release the supercritical refrigerant from storage device 20 (174). For example, controller 4 may release the pre-compressed, supercritical refrigerant from storage device 20 by opening storage device valve 22. Controller 4 may release the refrigerant to meet instantaneous cooling needs.

Controller 4, via refrigerant loop 6, may then deliver supercritical refrigerant to expansion device 14 (166) and provide cooling capacity at heat exchanger 16 via expanded refrigerant (168). For example, the supercritical refrigerant from storage device 20 may flow through expansion device 14 and heat exchanger 16, absorbing heat from the substance to be refrigerated.

Figure 9:
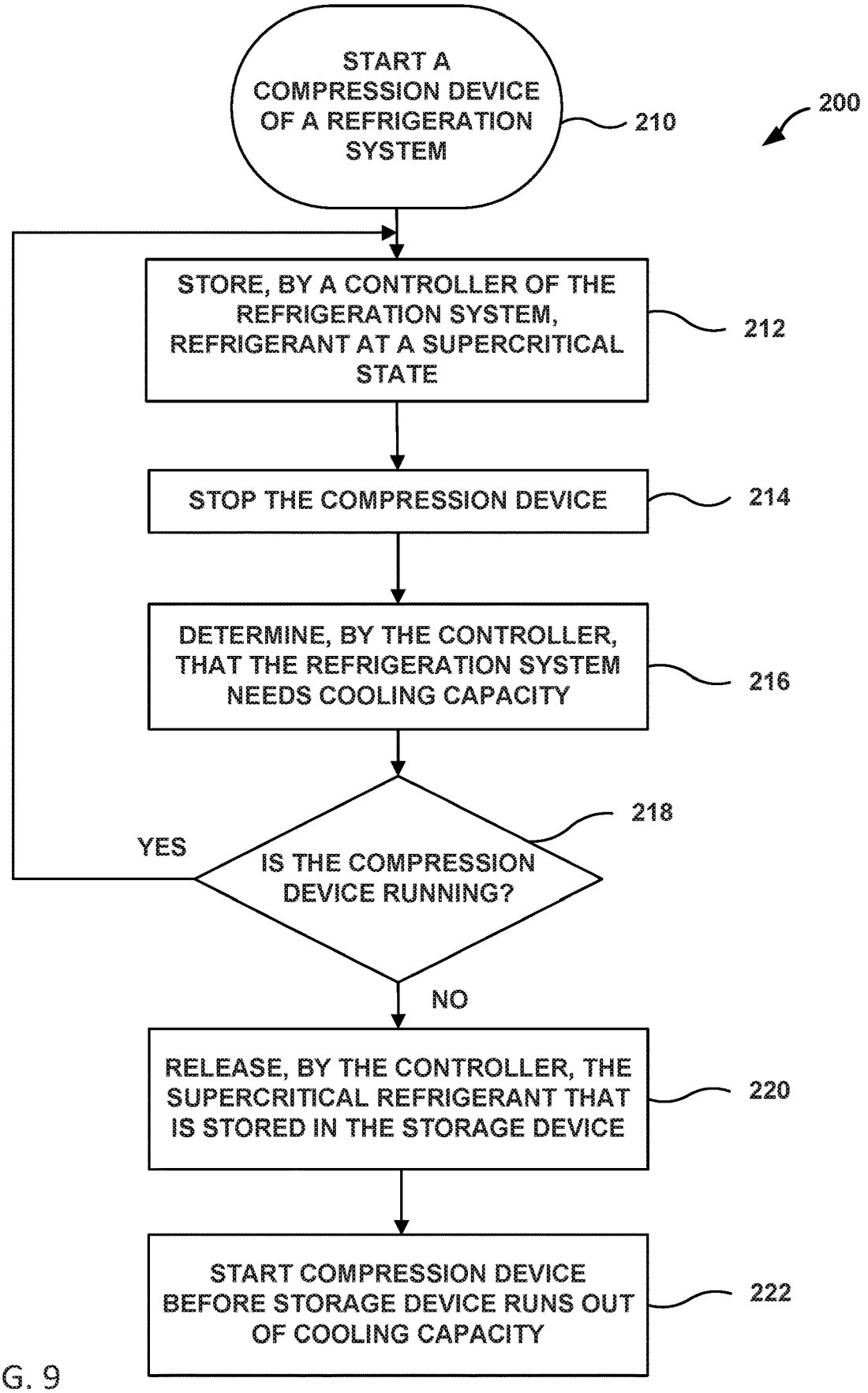
FIG. 9 is a flowchart illustrating example operations of a controller of an example refrigeration system that includes a supercritical, high pressure transient storage device, in accordance with some examples of this disclosure.

FIG. 9 is a flowchart illustrating example operations of a controller 4 of an example refrigeration system 2 that includes a supercritical, high pressure transient storage device 20, in accordance with some examples of this disclosure. Process 200 is described below in the context of controller 4 and refrigeration system 2 of FIG. 1, although other types of systems or circuits may be used to perform similar techniques.

In operation, controller 4 may start compression device 10 of refrigeration system 2 (210). Controller 4 may direct a mechanical power source to start delivering power to compression device 10. Compression device 10 may begin supplying supercritical refrigerant to refrigerant loop 6.

Controller 4 may store refrigerant at a supercritical state in storage device 20 (212) and may stop compression device 10 (214). Controller 4 may open storage device valve 22 to allow supercritical refrigerant in refrigerant loop 6 to enter storage device 20. Storage device 20 may store pre-compressed, supercritical refrigerant to provide immediate cooling capacity to refrigeration system 2. Controller 4 may use a decision algorithm to determine when to store or release refrigerant from storage device 20.

Controller 4 may then determine that refrigeration system 2 needs cooling capacity (216) and may determine whether compression device 10 is running (218). Controller 4 may determine that refrigeration system 2 needs cooling capacity by measuring the temperature of the substance to be refrigerated using a sensor or a thermostat. If the temperature of the substance to be refrigerated is near the maximum allowable temperature, controller 4 may determine that refrigeration system 2 needs cooling capacity.

If controller 4 determines that compression device 10 is running, controller 4 may return to step 212 and store refrigerant at a supercritical state in storage device 20. Controller 4 may open storage device valve 22 to allow supercritical refrigerant to enter storage device 20. Controller 4 may cause compression device 10 to supply more supercritical refrigerant to meet the need for cooling capacity.

If controller 4 determines that compression device 10 is not running, controller 4 may release the supercritical refrigerant that is stored in storage device 20 (220). Controller 4 may open storage device valve 22 to release pre-compressed, supercritical refrigerant from storage device 20. The pre-compressed supercritical refrigerant may provide cooling capacity as it passes through heat exchanger 16. Controller 4 may use a decision algorithm to determine when to store or release refrigerant from storage device 20.

Controller 4 may start compression device 10 before storage device 20 runs out of cooling capacity (222). Controller 4 may detect whether storage device 20 contains any pre-compressed supercritical refrigerant using a sensor. If storage device 20 is at or near empty, controller 4 may direct a mechanical power supply to begin supplying power to compression device 10.

The following examples may illustrate one or more of the techniques of this disclosure.

EXAMPLE 1

A refrigeration system comprising: a compression device configured to increase a pressure of a refrigerant, a first heat exchanger configured to reject heat from the refrigerant and reduce a temperature of the refrigerant, a storage device configured to store the refrigerant at a supercritical state, an expansion device configured to reduce the pressure of the refrigerant, a second heat exchanger configured to absorb heat into the refrigerant and increase the temperature of the refrigerant, and a controller configured to release the refrigerant from the storage device to the expansion device to provide cooling capacity to the refrigeration system.

EXAMPLE 2

The refrigeration system of example 1, wherein the controller is further configured to release the refrigerant from the storage device to the expansion device to provide cooling capacity while the compression device is stopped.

EXAMPLE 3

The refrigeration system of example 1 or 2, wherein the controller is further configured to release the refrigerant from the storage device to the expansion device to provide cooling capacity while simultaneously starting the compression device.

EXAMPLE 4

The refrigeration system of any one of examples 1 to 3, wherein the storage device is further configured to release the refrigerant from the storage device to provide cooling capacity after starting the compression device.

EXAMPLE 5

The refrigeration system of any one of examples 1 to 4, further comprising a valve coupled to the storage device, wherein the controller controls whether the valve is open or closed to store or release the refrigerant at the storage device.

EXAMPLE 6

The refrigeration system of any one of examples 1 to 5, wherein the controller is further configured to open the valve to store refrigerant in the storage device while the compression device is running

EXAMPLE 7

The refrigeration system of any one of examples 1 to 6, wherein the controller is further configured to open the valve to release refrigerant from the storage device to provide cooling capacity while the compression device is stopped.

EXAMPLE 8

The refrigeration system of any one of examples 1 to 7, further comprising a receiver configured to store the refrigerant at a subcritical state.

EXAMPLE 9

The refrigeration system of any one of examples 1 to 8, wherein the receiver is further configured to store refrigerant to prevent an over-pressurization of the refrigeration system.

EXAMPLE 10

The refrigeration system of any one of examples 1 to 9, wherein the refrigerant comprises carbon dioxide.

EXAMPLE 11

A method comprising: after starting a compression device of a refrigeration system, storing, by a controller of the refrigeration system, at a storage device of the refrigeration system, refrigerant at a supercritical state, after stopping the compression device, determining, by the controller, that the refrigeration system needs cooling capacity, and in response to determining that the refrigeration system needs cooling capacity while the compression device is stopped, releasing, by the controller, from the storage device, the refrigerant that is stored at the supercritical state.

EXAMPLE 12

The method of example 11, wherein releasing the refrigerant comprises releasing the refrigerant from the storage device into an expansion device of the refrigerant system from which the refrigerant provides cooling capacity to the refrigeration system while compression device is stopped.

EXAMPLE 13

The method of example 11 or 12, wherein releasing the refrigerant comprises releasing the refrigerant while simultaneously starting, by the controller, the compression device.

EXAMPLE 14

The method of any one of examples 11 to 13, wherein releasing the refrigerant comprises releasing the refrigerant after starting the compression device.

EXAMPLE 15

The method of any one of examples 11 to 14, wherein storing the refrigerant and releasing the refrigerant each comprise: controlling, by the controller, a valve coupled to the storage device.

EXAMPLE 16

The method of any one of examples 11 to 15, wherein storing the refrigerant at the supercritical state comprises opening, by the controller, the valve to store refrigerant at the storage device while the compression device is running.

EXAMPLE 17

The method of any one of examples 11 to 16, wherein releasing the refrigerant comprises opening, by the controller, the valve to release refrigerant from the storage device to provide cooling capacity while the compression device is stopped.

EXAMPLE 18

The method of any one of examples 11 to 17, further comprising storing, by the controller, at a receiver of the refrigeration system, the refrigerant at a subcritical state to prevent an over-pressurization of the refrigeration system.

EXAMPLE 19

The method of any one of examples 11 to 18, wherein the refrigerant comprises carbon dioxide.

EXAMPLE 20

A system comprising: means for, after starting a compression device of a refrigeration system, storing refrigerant at a supercritical state, means for, after stopping the compression device, determining that the refrigeration system needs cooling capacity, and means for, in response to determining that the refrigeration system needs cooling capacity while the compression device is stopped, releasing the refrigerant that is stored at the supercritical state.

Various examples have been described. These and other examples are within the scope of the following claims.

What is claimed is:

1. A refrigeration system comprising:

a compression device configured to increase a pressure of a refrigerant;

a first heat exchanger configured to reject heat from the refrigerant and reduce a temperature of the refrigerant;

a storage device configured to store the refrigerant at a supercritical state;

an expansion device configured to reduce the pressure of the refrigerant;

a second heat exchanger configured to absorb heat into the refrigerant and increase the temperature of the refrigerant, wherein the compression device, the first heat exchanger, the expansion device, and the second heat exchanger are connected by a refrigeration loop; and a controller configured to:

determine whether the refrigeration system needs cooling capacity based on a measurement of a temperature of a substance to be refrigerated;

provide the cooling capacity to the refrigeration system by releasing the refrigerant from the storage device directly to the refrigeration loop between the first heat exchanger and the expansion device in response to determining that the refrigeration system needs the cooling capacity;

determine that an amount of supercritical refrigerant stored in the storage device at the supercritical state is less than a threshold level; and restart the compression device in response to determining that the amount of supercritical refrigerant stored in the storage device at the supercritical state is less than the threshold level.

2. The refrigeration system of claim 1, wherein the controller is further configured to release the refrigerant from the storage device to the expansion device to provide the cooling capacity while simultaneously starting the compression device.

3. A method comprising:

after starting a compression device in a refrigeration loop of a refrigeration system, storing, by a controller of the refrigeration system, at a storage device of the refrigeration system, refrigerant at a supercritical state;

after stopping the compression device, determining, by the controller, whether the refrigeration system needs cooling capacity based on a measurement of a temperature of a substance to be refrigerated;

providing, by the controller, the cooling capacity to the refrigeration system by releasing, from the storage device and directly to the refrigeration loop between a first heat exchanger and an expansion device of the refrigeration system, the refrigerant that is stored at the supercritical state in response to determining that the refrigeration system needs the cooling capacity while the compression device is stopped;

determining, by the controller, that an amount of supercritical refrigerant stored in the storage device at the supercritical state is less than a threshold level; and restarting, by the controller, the compression device in response to determining that the amount of supercritical refrigerant stored in the storage device at the supercritical state is less than the threshold level.

4. The method of claim 3, wherein releasing the refrigerant comprises releasing the refrigerant while simultaneously starting, by the controller, the compression device.

5. The method of claim 4, wherein releasing the refrigerant comprises releasing the refrigerant after starting the compression device.

6. The method of claim 3, wherein storing the refrigerant and releasing the refrigerant each comprise controlling, by the controller, a valve coupled to the storage device, wherein the valve is also coupled to the refrigeration loop between the first heat exchanger and the expansion device.

7. The method of claim 6, wherein storing the refrigerant at the supercritical state comprises opening, by the controller, the valve to store refrigerant at the storage device while the compression device is running.

8. The method of claim 6, wherein releasing the refrigerant comprises opening, by the controller, the valve to release refrigerant from the storage device to provide the cooling capacity while the compression device is stopped.

9. The method of claim 3, further comprising storing, by the controller, at a receiver of the refrigeration system, the refrigerant at a subcritical state to prevent an over-pressurization of the refrigeration system.

10. The method of claim 3, wherein the refrigerant comprises carbon dioxide.

11. A refrigeration system comprising:

a compression device configured to increase a pressure of a refrigerant;

a first heat exchanger configured to reject heat from the refrigerant and reduce a temperature of the refrigerant;

a storage device configured to store the refrigerant at a supercritical state;

an expansion device configured to reduce the pressure of the refrigerant;

a second heat exchanger configured to absorb heat into the refrigerant and increase the temperature of the refrigerant; and a controller configured to:

determine whether the refrigeration system needs cooling capacity based on a measurement of a temperature of a substance to be refrigerated;

provide the cooling capacity to the refrigeration system by releasing the refrigerant from the storage device to the expansion device in response to determining that the refrigeration system needs the cooling capacity;

determine that an amount of refrigerant stored at the supercritical state in the storage device is less than a threshold level; and restart the compression device in response to determining that the amount of refrigerant stored at the supercritical state in the storage device is less than the threshold level.

12. The refrigeration system of claim 11, wherein the storage device is further configured to release the refrigerant from the storage device to provide the cooling capacity after starting the compression device.

13. The refrigeration system of claim 11, further comprising a valve coupled to the storage device, wherein the valve is also coupled to the refrigeration loop between the first heat exchanger and the expansion device, and wherein the controller controls whether the valve is open or closed to store or release the refrigerant at the storage device.

14. The refrigeration system of claim 13, wherein the controller is further configured to open the valve to store refrigerant in the storage device while the compression device is running.

15. The refrigeration system of claim 13, wherein the controller is further configured to open the valve to release refrigerant from the storage device to provide the cooling capacity while the compression device is stopped.

16. The refrigeration system of claim 13, wherein the controller is further configured to close the valve to not release the refrigerant from the storage device in response to determining that the refrigeration system does not need the cooling capacity.

17. The refrigeration system of claim 11, further comprising a receiver configured to store the refrigerant at a subcritical state.

18. The refrigeration system of claim 17, wherein the receiver is further configured to store refrigerant to prevent an over-pressurization of the refrigeration system.

19. The refrigeration system of claim 11, wherein the refrigerant comprises carbon dioxide.

20. The refrigeration system of claim 11, wherein the controller is further configured to release the refrigerant from the storage device to the expansion device to provide the cooling capacity while simultaneously starting the compression device.

* * * * *